US008858364B2

(12) United States Patent
Deng et al.

(10) Patent No.: US 8,858,364 B2
(45) Date of Patent: Oct. 14, 2014

(54) WELDED IRON-TYPE CLUBHEAD WITH THIN HIGH-COR FACE

(75) Inventors: Xinhui Deng, Carlsbad, CA (US); Bing-Ling Chao, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 12/332,210

(22) Filed: Dec. 10, 2008

(65) Prior Publication Data

US 2009/0149277 A1 Jun. 11, 2009

Related U.S. Application Data

(63) Continuation-in-part of application No. 11/073,158, filed on Mar. 4, 2005, now Pat. No. 7,491,136.

(51) Int. Cl.
*A63B 53/04* (2006.01)
*A63B 53/00* (2006.01)

(52) U.S. Cl.
CPC ..... *A63B 53/047* (2013.01); *A63B 2209/00* (2013.01); *A63B 53/0475* (2013.01); *A63B 2053/005* (2013.01); *A63B 2053/0458* (2013.01); *A63B 2053/0416* (2013.01); *A63B 2053/0491* (2013.01); *A63B 2053/0408* (2013.01)
USPC ..... 473/350

(58) Field of Classification Search
USPC ..... 473/324–350
See application file for complete search history.

(56) References Cited

U.S. PATENT DOCUMENTS

| | | | | |
|---|---|---|---|---|
| 2,931,098 | A | 4/1960 | Johnson, Jr. | |
| 3,193,384 | A | 7/1965 | Richardson | |
| 3,652,093 | A * | 3/1972 | Reuter, Jr. | 473/340 |
| 4,314,863 | A | 2/1982 | McCormick | |
| 4,968,357 | A | 11/1990 | Liu | |
| 5,024,437 | A * | 6/1991 | Anderson | 473/342 |
| 5,089,067 | A * | 2/1992 | Schumacher | 148/325 |
| 5,167,733 | A | 12/1992 | Hsieh | |
| 5,184,823 | A * | 2/1993 | Desboilles et al. | 473/345 |
| 5,297,803 | A * | 3/1994 | Solheim | 473/350 |
| 5,419,560 | A | 5/1995 | Bamber | |
| 5,423,534 | A * | 6/1995 | Solheim | 473/350 |
| 5,429,353 | A * | 7/1995 | Hoeflich | 473/350 |
| 5,464,216 | A * | 11/1995 | Hoshi et al. | 473/349 |
| 5,518,240 | A * | 5/1996 | Igarashi | 473/345 |
| 5,536,011 | A * | 7/1996 | Gutowski | 473/350 |
| 5,540,437 | A * | 7/1996 | Bamber | 473/327 |
| 5,564,705 | A * | 10/1996 | Kobayashi et al. | 473/334 |
| 5,584,770 | A * | 12/1996 | Jensen | 473/350 |

(Continued)

OTHER PUBLICATIONS

Callister, Jr., William D., Materials Science and Engineering: An Introduction, 4th Edition. New York: John Wiley & Sons, Inc., copyright 1997, p. 775.

*Primary Examiner* — Alvin Hunter
(74) *Attorney, Agent, or Firm* — Klarquist Sparkman, LLP

(57) ABSTRACT

Clubheads for iron-type golf clubs are disclosed. An example clubhead has a front including an iron-type face. The front is forged of a material such as C455 or 17-4 PH stainless steel. A heel, sole, toe, and top-line are situated rearwardly of the face, and a rear is situated rearwardly of the heel, sole, toe, and top-line. The face has one or more of: a COR of at least 0.8, a thickness, in a thinnest portion of the face, of no greater than 2.0 mm, and an area of less than 3000 $mm^2$.

12 Claims, 4 Drawing Sheets

(56) References Cited

U.S. PATENT DOCUMENTS

| | | | | | |
|---|---|---|---|---|---|
| 5,683,310 | A * | 11/1997 | Chen | 473/349 |
| 5,697,855 | A | 12/1997 | Aizawa | |
| 5,755,627 | A * | 5/1998 | Yamazaki et al. | 473/345 |
| 5,851,157 | A * | 12/1998 | Koide et al. | 473/305 |
| 5,871,408 | A * | 2/1999 | Chen | 473/409 |
| 6,015,354 | A * | 1/2000 | Ahn et al. | 473/256 |
| 6,083,118 | A * | 7/2000 | Martins et al. | 473/334 |
| 6,149,534 | A * | 11/2000 | Peters et al. | 473/345 |
| 6,247,636 | B1 * | 6/2001 | Sun | 228/135 |
| 6,309,309 | B1 | 10/2001 | Beach et al. | |
| 6,458,045 | B1 * | 10/2002 | Chen | 473/342 |
| 6,506,129 | B2 * | 1/2003 | Chen | 473/329 |
| 6,520,868 | B2 | 2/2003 | Chen | |
| 6,617,050 | B2 | 9/2003 | Chao | |
| 6,685,577 | B1 | 2/2004 | Scruggs et al. | |
| 6,739,983 | B2 | 5/2004 | Helmstetter et al. | |
| 6,743,114 | B2 | 6/2004 | Best | |
| 6,743,118 | B1 | 6/2004 | Soracco | |
| 6,743,120 | B1 * | 6/2004 | Chen | 473/349 |
| 6,793,591 | B2 * | 9/2004 | Takeda | 473/342 |
| 6,811,496 | B2 | 11/2004 | Wahl et al. | |
| 6,984,180 | B2 * | 1/2006 | Hasebe | 473/291 |
| 7,008,331 | B2 * | 3/2006 | Chen | 473/342 |
| 7,083,525 | B2 | 8/2006 | Pond et al. | |
| 7,121,958 | B2 * | 10/2006 | Cheng et al. | 473/345 |
| 7,126,339 | B2 * | 10/2006 | Nagai et al. | 324/345 |
| 7,169,057 | B2 * | 1/2007 | Wood et al. | 473/290 |
| 7,258,628 | B2 * | 8/2007 | Huang et al. | 473/342 |
| 7,371,188 | B2 * | 5/2008 | Chen | 473/329 |
| 7,491,136 | B2 * | 2/2009 | Deng et al. | 473/349 |
| 7,530,902 | B2 * | 5/2009 | Nakamura | 473/334 |
| 7,892,106 | B2 * | 2/2011 | Matsunaga | 473/290 |
| 2001/0055996 | A1 * | 12/2001 | Iwata et al. | 473/350 |
| 2002/0082118 | A1 * | 6/2002 | Iwata et al. | 473/349 |
| 2003/0082067 | A1 | 5/2003 | Chao | |
| 2003/0176231 | A1 * | 9/2003 | Hasebe | 473/291 |
| 2003/0176232 | A1 * | 9/2003 | Hasebe | 473/291 |
| 2004/0023730 | A1 * | 2/2004 | Nagai et al. | 473/345 |
| 2004/0171434 | A1 | 9/2004 | Radcliffe et al. | |
| 2004/0192465 | A1 | 9/2004 | Erb et al. | |

* cited by examiner

WELDED IRON-TYPE CLUBHEAD WITH THIN HIGH-COR FACE

CROSS-REFERENCE TO RELATED APPLICATION

This application is a continuation-in-part of U.S. patent application Ser. No. 11/073,158, filed on Mar. 4, 2005 now U.S. Pat. No. 7,491,136, and published as U.S. Patent Application Publication No. US 2006/0199661 on Sep. 7, 2006, the entire contents of which are incorporated herein by reference.

FIELD

This disclosure pertains to, inter alia, golf-clubs and golf-club heads ("clubheads"). More specifically, the disclosure pertains to iron-type clubheads made of multiple pieces that are welded together.

BACKGROUND

A set of golf clubs includes various types of clubs for use in different respective conditions or circumstances in which the ball must be hit during a golf game. An example set of clubs includes a "driver" for hitting the ball the longest distance on a course, several fairway "woods" for hitting the ball shorter distances than the driver, a set of irons (including one or more "wedges") for hitting the ball a range of distances that are typically shorter than produced when hitting the ball using a wood, and at least one putter.

Irons and putters characteristically have a flat (planar) face, wherein the "face" or "striking face" is the surface that normally contacts the ball whenever the ball is being hit with the club. Irons have distinctively angled faces having for achieving lofts ranging from about 18 degrees to about 60 degrees. "Loft" is discussed later below.

A golf club comprises a head (also called a "clubhead"), a shaft affixed to the clubhead, and a grip affixed to the shaft. An exemplary head for an iron 10 is shown in FIG. 3, and includes a face 12, a sole 14, a toe 16, a heel 18, a back 20, a top line 22, and a hosel 24. The sole 14 usually is cambered or otherwise shaped to minimize friction if the clubhead should contact the ground during a swing. The hosel 24 receives the distal terminus of the shaft 26 of the golf club and is the means by which the head 10 is fastened to the shaft 26. The angle of the hosel 24 to the rest of the head 10 is the "lie" of the head 10. The face 12 of an iron typically is "offset," wherein offset is a distance from the front-most part of the hosel 24 to the front-most part, or leading edge, of the head 10. The face 12 typically has a series of score lines (grooves) 28 extending substantially horizontally across the face 12. The particular depth and dimensions of the score lines 28 are regulated by United States Golf Association (USGA) rules because the score lines contribute to the launch conditions of a ball struck off the face 12.

"Loft" is a measurement, in degrees, of the angle at which the face 12 of the clubhead 10 lies relative to a perfectly vertical plane. In a typical set of irons from the "longest" iron to the "shortest" iron, the faces of the clubheads have progressively greater loft, which means that the faces are tilted progressively more from vertical. Loft affects the launch angle, backspin, and velocity of a struck ball. Striking a ball with a short iron will typically result in the ball having a higher launch angle and greater backspin compared to a ball struck with a long iron. Consequently, the trajectory of a ball struck with a short iron will typically be higher and shorter than the trajectory of a ball struck with a long iron. To aid the golfer, the irons are numbered to codify the loft; the higher the number, the greater the loft.

Hitting the ball at any location on the face 12 of an iron (or any golf club) does not yield the same result. Every club has a "sweet spot" (a zone located roughly in a central region of the face) that represents the best hitting zone on the face 12 for maximizing the probability of the golfer achieving the best and most predictable shot using the particular club. While executing a swing of the club, the golfer strives to hit the ball inside the sweet spot to provide the greatest probability that the ball will have the intended trajectory. Providing a clubhead with a larger sweet spot generally makes the clubhead more "forgiving" of a golfer's variability in swinging the club and striking a ball with it, thus providing the golfer with a greater assurance of making the intended shot.

SUMMARY

The foregoing need is addressed by, inter alia, clubheads and methods for their manufacture, as disclosed below. An embodiment of a clubhead comprises a forged front piece and a rear piece. The front piece includes the hosel, an iron-type face, a front heel portion, a front sole portion, a front toe portion, a front top-line portion, a respective interface surface facing substantially rearwardly of the face. The rear piece includes a rear heel portion, a rear sole portion, a rear toe portion, a rear top-line portion, and a respective interface surface facing the interface surface of the front piece. The interface surfaces of the front and rear pieces form a contact interface. A continuous weld extends circumferentially around the contact interface, thereby attaching the front and rear pieces together at the contact interface. The weld includes a fusion zone that, at substantially all locations around the contact interface, extends into the contact interface in respective normal directions relative to the face.

It is particularly desirable that the weld be formed by laser welding, which forms an unusually narrow fusion zone. By adjusting the power output of the laser and the speed at which welding progresses, the depth of the weld can be increased or decreased as required without excessive widening of the fusion zone. Laser welding also facilitates preventing the weld from encroaching onto the face. During use of the clubhead in striking a ball, the narrow circumferential weld (situated substantially in a plane behind the face) experiences mainly compressive forces generally in the direction of a normal to the face. The weld is particularly resistant to strong impact forces, compared to weaker face welds on certain conventional iron-type clubheads. Another advantage of laser welding is that the top-line of the clubhead can be made thinner than conventionally. An exemplary thin thickness range is 4-7 mm, which provides good visual aesthetics and "feel" for many golfers.

The front piece desirably is forged of a high-strength steel such as a maraging steel, a maraging stainless steel, or a PH (precipitation-hardened) stainless steel. For example, a C455 or 17-4 steel can be used. The front and rear pieces can be made of different or similar materials, and the rear piece can be forged or cast. A distinct advantage of forging the front piece of a high-strength steel is that the face can be made significantly thinner than conventionally without compromising strength and while enhancing other parameters. For example, the face can have a thickness of less than 2.7 mm, or a thickness of less than 2.0 mm, or a thickness in the range of 1.6 to 2.0 mm. Accompanying these thinner but high-strength faces is an increased COR (coefficient of restitution), at least 0.8 compared to a maximum of about 0.78 in conventional iron-type clubheads. These advantageous properties are achievable even in so-called "small" faces (having an area of less than 3000 $mm^2$).

In addition to forming a thin face, forging can also provide the reverse surface of the face with a desired thickness profile. For example, the reverse surface can be formed with an inverted cone profile for enhancing the "sweet spot" of the face.

The thinner face of the subject clubheads frees up discretionary mass that can be relocated, for example, onto the rear piece for desired positioning of the CG (center of gravity) of the clubhead, or for desired manipulation of the MOI (moment of inertia). For example, the rear piece can be configured with weights or cartridges for redistributing the mass of the clubhead.

Another embodiment of a clubhead comprises a front and a rear welded together. The front includes an iron-type face. Rearwardly of the face is the heel, sole, toe, and top-line of the clubhead. The rear is situated rearwardly of the heel, sole, toe, and top-line. The face of some embodiments has a combination of a COR of at least 0.8 and a thickness, in a thinnest portion of the face, of no greater than 2.0 mm. The face of other embodiments has a combination of a COR of at least 0.8 and an area of less than 3000 $mm^2$. The front desirably is forged, as summarized above, and desirably includes the hosel.

Also provided are golfing irons, each comprising a shaft connected to a clubhead such as summarized above.

Also provided are methods for making an iron-type clubhead. An embodiment of such a method comprises forging a front piece having a face, a respective interface surface rearward of the face, and respective portions of a heel, a sole, a toe, and a top-line between the interface surface and the face. Also formed is a rear piece having a respective interface surface and respective portions of the heel, sole, toe, and top-line situated rearwardly of the interface surface. The interface surfaces are placed in contact and alignment with each other to form a contact interface. A continuous weld is formed that extends into and peripherally around the contact interface to attach the front and rear pieces together, the weld being, at substantially all locations thereon, substantially perpendicular to a normal to the face. As summarized above, the weld desirably is formed by laser welding.

The foregoing and additional features and advantages of the subject methods will be more readily apparent from the following detailed description, which proceeds with reference to the accompanying drawings.

DETAILED DESCRIPTION

Figure 1A:
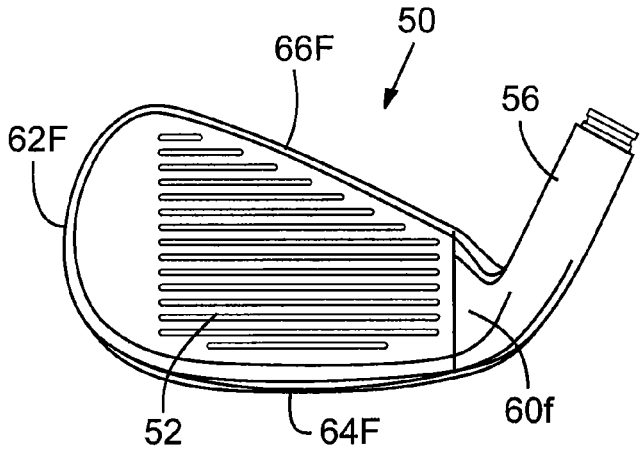
FIGS. 1(A)-1(C) are orthogonal views of an embodiment of a two-piece iron-type clubhead, as described herein and in the parent case, U.S. patent application Ser. No. 11/073,158 (published as U.S. Patent Application Publication No. US 2006/0199661). See FIGS. 1A-1C, respectively, in the parent case. The rear piece 54 shown in FIGS. 1(B) and 1(C) is called a "central weight" back.

As used in this application and in the claims, the singular forms "a," "an," and "the" include the plural forms unless the context clearly dictates otherwise. Additionally, the term "includes" means "comprises." Further, the term "coupled" encompasses mechanical as well as other practical ways of coupling or linking items together, and does not exclude the presence of intermediate elements between the coupled items.

The described things and methods described herein are representative embodiments and should not be construed as being limiting in any way. Instead, this disclosure is directed toward novel and non-obvious features and aspects of the various disclosed embodiments, alone and in various combinations and sub-combinations with one another. The disclosed things and methods are not limited to any specific aspect or feature or combinations thereof, nor do the disclosed things and methods require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and method. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Iron-type clubheads discussed below have traditionally small faces (generally in the range of 2950-3000 $mm^2$). They also have faces that are made of high-strength steel, and that are substantially thinner (e.g., 2.00 mm or less thickness at the center of the sweet spot on the face) than conventional iron-type clubheads. The subject clubheads have a narrower top-line (e.g., 4.0 to 6.0 mm) a higher COR (e.g., 0.80 up to a USGA limit of about 0.83) than conventional irons. In one embodiment the COR is measured by utilizing a test ball speed of 160 feet per second. As a result of these characteristics, more discretionary mass is available for placement elsewhere in the clubhead such as the toe, heel, and/or back, which can provide the clubhead with a higher MOI and a more rearwardly located CG than conventional iron-type clubheads.

Various embodiments of the subject clubheads comprise a front piece and a rear piece. As described in the co-pending parent application (U.S. patent application Ser. No. 11/073,158, filed on Mar. 4, 2005, published as U.S. Patent Application Publication No. US 2006/0199661 on Sep. 7, 2006), the front piece includes the face, the hosel, and front portions of the top-line, toe, sole, and heel. The rear piece includes the back and rear portions of the top-line, toe, sole, and heel.

In many embodiments the front piece is forged, desirably of maraging steel, maraging stainless steel, or precipitation-hardened (PH) stainless steel. Forging provides the front piece, including the face, with very high strength, which allows the face to be made thinner than in conventional iron-type clubheads. The rear piece is made of steel or stainless steel, forged or cast, and includes corresponding rear portions of the top-line, toe, sole, and heel. The rear piece can be made of the same material as the front piece.

The front and rear pieces are fitted together and welded around the full circumference (360°) of the clubhead (i.e., the circumference extending around the top-line, toe, sole, and heel). In many embodiments the weld is a laser weld. The weld is essentially a butt weld that, when made by a laser, includes a narrow and deep fusion zone (FZ) and very narrow heat-affected zones (HAZs) flanking the fusion zone. The depths of these zones extend along respective weld axes that are perpendicular to the direction of load (face-normal direction) around the full 360° circumference of the weldment. Thus, in contrast to conventional welded iron-type clubheads, the faces of the subject clubheads are weld-free, with the FZs and HAZs being fully away from the face area. The narrow FZ and HAZ achieved by laser welding also allow the top-line to be made thinner (e.g., 4-6 mm) than a conventional thick top-line. The thin top-line is aesthetically pleasing to many golfers. Even with a thinner face, the subject iron-type clubhead retains uncompromised strength and durability.

Compared to TIG welding and other welding conventional techniques, laser welding is advantageous for making the subject clubheads because laser welding concentrates more energy at the weld site than conventional welding techniques such as TIG welding. Laser welding also produces a more localized melt, less material interdiffusion, and reduced material fatigue during subsequent use.

Figure 1B:
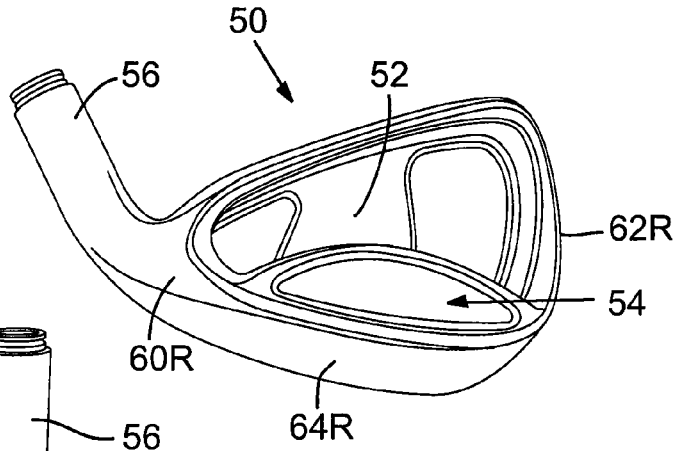
Figure 1C:
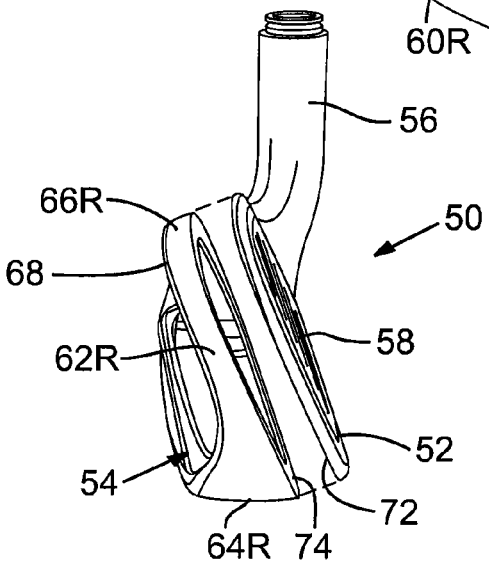

General aspects of a first representative embodiment of a clubhead 50 are shown in FIGS. 1(A)-1(C). The clubhead 50 comprises a front piece 52 and a rear piece 54. The front piece 52 includes the hosel 56 and the face 58. The face 58 is surrounded by respective front portions of the heel 60F, toe 62F, sole 64F, and top-line 66F. To the rear of these respective portions is a rearward-facing interface surface 72, extending 360° circumferentially around the front piece 52, configured to engage a corresponding forward-facing interface surface 74 on the rear piece 54. Desirably, the interface surface 72 is approximately parallel to the plane of the face 58. The rear piece 54 includes the back 68 as well as respective rear portions of the heel 60R, toe 62R, sole 64R, and top-line 66R. Frontward of these respective portions is the interface surface 74 extending 360° circumferentially around the rear piece 54. As shown in FIG. 1(C) (dashed line), the interface surfaces 72, 74 fit together and form a "contact interface" that is bonded together by laser welding.

As noted, the front piece 52 in many embodiments is forged, desirably of maraging steel, maraging stainless steel, or precipitation-hardened (PH) stainless steel. In general, "maraging steels" (in which the word "maraging" is a contraction of "martensitic" and "aging") have high strength, toughness, and malleability. Being low in carbon, they derive their strength from precipitation of inter-metallic substances other than carbon. The principal alloying element is nickel (usually 15 to nearly 30%). Other alloying elements producing inter-metallic precipitates in these steels include cobalt, molybdenum, and titanium. An example maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. An example maraging stainless steel is C455. Example precipitation-hardened (PH) stainless steels are 17-4, 15-5, and 17-7. Applicants believe that the subject clubheads are the first in the art in which at least the front pieces are forged of these materials.

Forging is performed by hot press forging using a progressive series of dies. Forging temperature is in the plastic-deformation range of 900-1200° C., depending upon the alloy. After forging, the front pieces 52 are subjected to an appropriate heat-treatment. For example, 17-4 PH stainless steel forgings are heat-treated by 1040° C. for 90 minutes, solution-quenched; C455 stainless steel forgings are solution heat-treated at 830° C. for 90 minutes, then quenched.

Aside from the materials for making the front piece 52, example materials for making the rear piece 54 are carbon steel (e.g., 1020, 1030, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel), ferritic stainless steel (e.g., 430 stainless steel), or martensitic stainless steel (e.g., 410 stainless steel). If the rear piece 54 is made of a different steel than the front piece 52, the weldment will be of dissimilar materials, but this is not a problem, especially with a laser weldment.

If desired, the rear piece 54 can include one or more features such as cartridges, weighting elements, and/or inserts or applied bodies as used for CG placement, vibration control or damping, acoustic control or damping, COR manipulation, or the like. For example, U.S. Pat. No. 6,811,496, incorporated herein by reference in its entirety, discusses the attachment of mass-altering pins or cartridges ("weighting elements"). See also U.S. patent application Ser. No. 11/899,985, incorporated herein by reference in its entirety, for discussion of movable weights used in clubheads. The rear surface of the face of the front piece can include, for example, a "damping badge" or the like for visually aesthetic reasons and/or for manipulation of "feel."

After forming the front and rear pieces 52, 54, their respective interface surfaces 72, 74 are finish-machined as required to ensure they will form a good contact interface. The hole in the hosel 56 for the shaft can be bored at this time. The interface surfaces 72, 74 desirably are planar for ease of finish machining and fitting together. Planar surfaces fit together well without significant intervening gap(s), but the two pieces 52, 54 must be aligned with each other for welding. To such end, planar interface surfaces 72, 74 desirably include any of various alignment aids such as edges, lips, pins, nubbins, male-female detents, or the like that mutually engage whenever the interface surfaces are brought into contact with each other. Alternatively, the interface surfaces 72, 74 can have more complex topography, so long as the topographies are complementary to each other. Non-planar interface surfaces 72, 74 can be configured such that they are self-aligning, in which event alignment aids may not be necessary. For laser welding, the pieces 52, 54 are held together as an assembly using a clamp or fixture to ensure substantially no gap between the interface surfaces 72, 74. The clamp or fixture can be configured to align the two pieces 52, 54 without having to provide the pieces with alignment aids.

Figure 4:
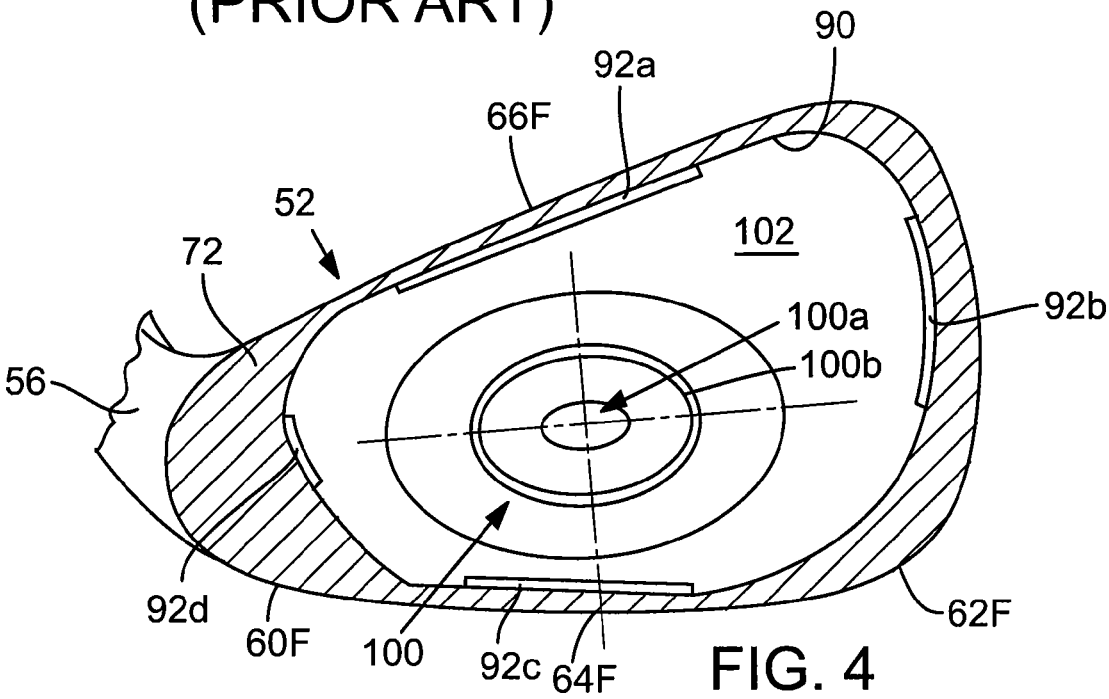
FIG. 4 is a plan view of the rear of an embodiment of the front piece, including an exemplary sweet spot and showing an exemplary configuration of the interface surface (hatched).
Figure 5B:
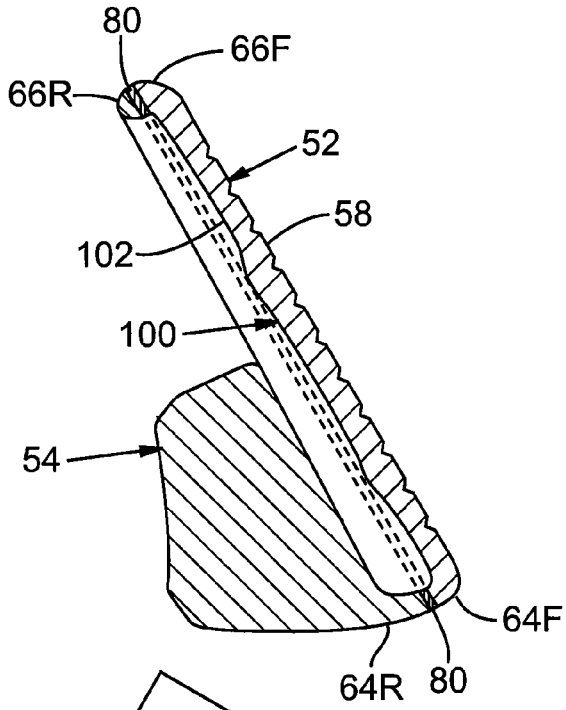
FIG. 5(B) is a sectional view along the lines B-B in FIG. 5(A).
Figure 5A:
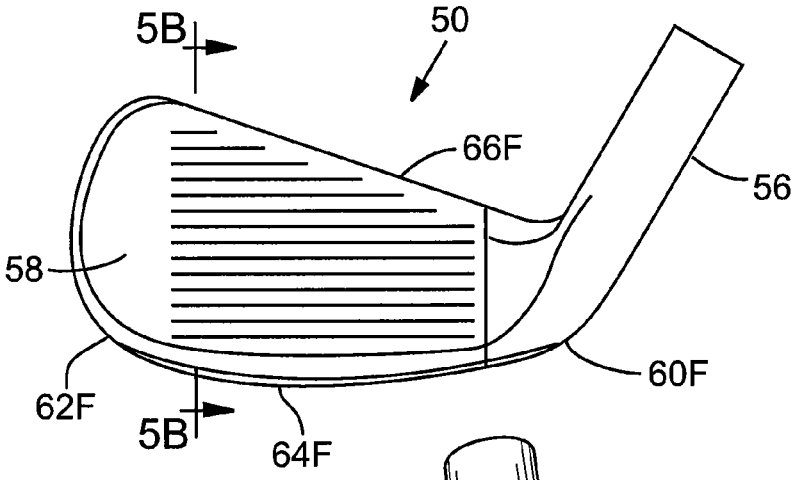
FIG. 5(A) is a front view of an embodiment of a finished iron-type clubhead.

A rear view of an exemplary front piece 52 is shown in FIG. 4, depicting the top-line 66F, heel 60F, sole 64F, toe 62F, and interface surface 72. The interface surface 72 varies in radial width (hatched area) around its circumference (in the plane of the page). For example, in this embodiment, the radial width is greatest in the region of the hosel 56 and least along the top line 66F and sole 64F. The profile of radial width denotes that the interface surface 72 has an inside edge 90. Regions of the interface-surface plane (plane of the page) that are inboard of the inside edge 90 are not part of the interface surface but rather are below the plane. The complementary interface surface 74 on the rear piece 54 (not shown) has a radial-width profile that is a mirror image of the radial-width profile of the depicted interface surface 72.

The inside edge 90 of the depicted embodiment includes projections 92*a*, 92*b*, 92*c*, 92*d* that serve as alignment aids for aligning the rear piece 54 to the front piece 52. The projections 92*a*-92*d* extend above the plane of the page and collectively fit just inside the inside edge of the interface surface 74 of the rear piece 54. Alternatively to multiple projections 92*a*-92*d*, a single continuous projection extending fully around the circumference of the inside edge 90 can be used. Further alternatively, the projections 92*a*-92*d* can be replaced by multiple pins projecting above the plane of the page and that collectively fit just inside the inside edge of the interface surface 74. Further alternatively, multiple pins can be located on the interface surface 72 and that fit into complementary holes in the interface surface 74. Further alternatively, multiple convex domes can be provided on the interface surface 72 that engage respective concave depressions on the interface surface 74. It will be understood that, in these and other alternative embodiments, the projecting alignment aids can be located on the rear piece 54 rather than the front piece 52.

Also visible in FIG. 4 is an exemplary pattern of thickness distribution of the sweet spot 100 on the rear surface 102 of the face. The depicted sweet spot 100 is an ellipse (of which the major axis is nearly horizontal), including a central zone 100*a* and a surrounding ridge 100*b*. By way of example, the rear surface 102 has a nominal thickness (extending to the face 58) of 1.80 mm, the ridge 100*b* has a thickness of 2.00 mm, and the central zone 100*a* has a thickness of 2.00 mm. Outward from the ridge 100*b*, the thickness tapers back to 1.80 mm. Other thickness profiles are also possible in the range of 1.6 to less than 2.7 mm. It is important to note that the thickness profiles (and low thickness values) can be achieved during forging of the front piece 52. In one embodiment a 0.5 mm to 1.0 mm machine stock plate can be added to the face 58 to increase tolerance control. After forging the face 58 can be slightly milled and engraved with scorelines. It is remarkable that such thin structures are achievable by forging, especially since conventional forged iron-type clubheads have face thicknesses of greater than 2.7 mm. A key advantage of being able to forge such a thin face 58 is the consequential freeing up of discretionary mass (up to approximately 20 g) that can be placed elsewhere in the clubhead (particularly in the rear piece 54) for manipulation of the MOI and CG location.

The particular profile of the sweet spot 100 described above is an example of so-called "inverted cone" configuration. Inverted-cone configurations are discussed in, for example, U.S. Pat. Nos. 6,800,038; 6,824,475; 6,904,663; and 6,997,820, all incorporated herein by reference.

During welding, the assembly comprising the front piece 52 fitted to and aligned with the rear piece 54 is moved relative to the laser, the laser is moved relative to the assembly, or both. A currently preferred laser for welding is a $CO_2$ cw laser having an adjustable output power in the range of 1350-2000 W. Turning now to FIG. 2(D), welding desirably begins near the hosel where the radial width of the interface surfaces 72, 74 is greatest (FIG. 4). Welding progresses in a continuous manner around the contact interface 86. At each location the "weld axis" 88 is normal to the surface. The speed at which the laser can be moved relative to the surface is desirably adjustable within the range of 40 to 80 cm/min.

The weld desirably penetrates substantially fully (90% or more) into the radial width of the contact interface. Minimum useful penetration is about 1 mm, but can be greater, depending on the radial width of the contact interface at the location being welded. The radial width changes around the circumference of the contact interface (see hatched region in FIG. 4), ranging from 1.4 mm (e.g., top-line) to 4.0 mm (near the hosel). Hence, at 90% penetration, the weld depth is in the range of approximately 1.25 mm to 3.60 mm. At regions of the deepest welds the surficial width of the fusion zone is about 2 mm, and the fusion zone tends to become narrower with increasing depth. Welding is not performed at a constant power or speed. The output power of the laser and the progression rate of the laser around the circumference are controllably adjusted as required to apply more power for a longer time in regions where the radial width is greatest (requiring the "deepest" weld) and to apply less power for less time in regions where the radial width is least (requiring the "shallowest" weld).

Figure 2A:
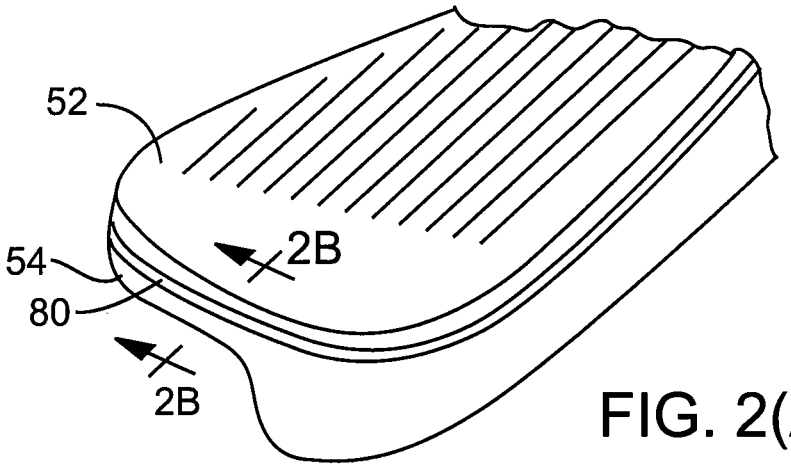
FIG. 2(A) is a perspective view of a portion of the blade of an embodiment that has been laser-welded around the circumference (top-line, heel, sole, toe) of the contact interface of a rear piece fitted to a front piece.
Figure 2B:
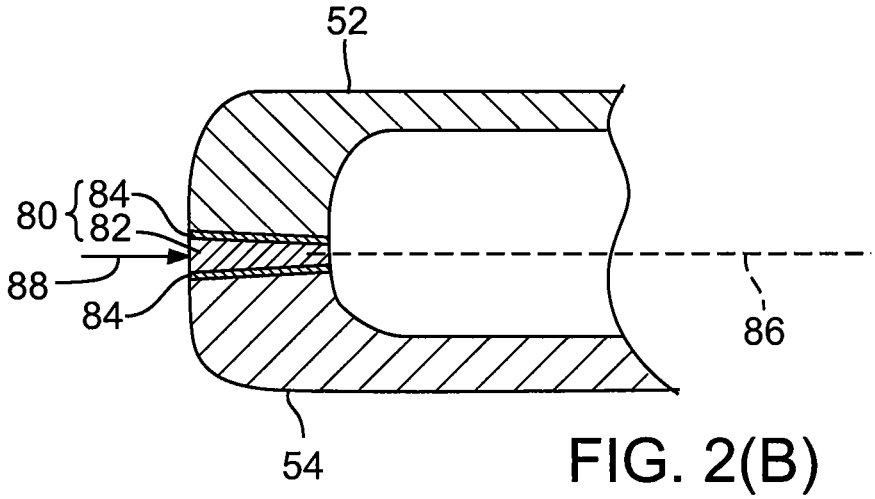
FIG. 2(B) is an enlargement of a partial section along the lines B-B in FIG. 2(A).
Figure 2C:
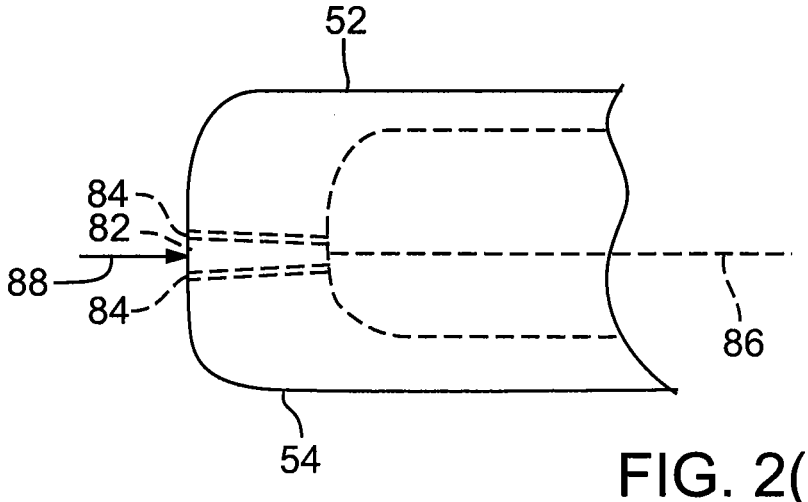
FIG. 2(C) is a further enlargement of the partial section shown in FIG. 2(B).
Figure 2D:
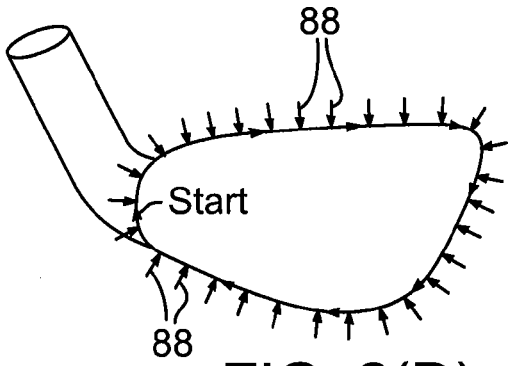
FIG. 2(D) is a substantially plan view of a clubhead, showing the path of laser welding around the circumference of the contact interface.

A schematic cross-section of one location on the laser weldment is shown in FIGS. 2(A)-2(C). FIG. 2(A) shows a portion of the rear piece 54, a portion of the front piece 52, a portion of the contact interface 86, and a portion of the weld zone 80 extending along the perimeter of the contact interface. The weld zone 80 includes a narrow fusion zone (FZ) 82 flanked by extremely narrow heat-affected zones (HAZs) 84. The FZ 82 and HAZs 84 tend to be wider at the surface and are progressively narrower with increasing depth of the weld. In any event, the width of the weld zone 80 is much less than would be achieved by conventional welding methods such as TIG welding.

At all locations around the 360° periphery of the contact interface 86, the respective weld axes 88 (and thus the fusion zone 82) extend substantially perpendicularly to the direction of a load (ball-impact force) that would be applied to the face 58 during use. In the figure, all the weld axes 88 are in the plane of the contact interface 86 but with different orientation so as to be perpendicular to their respective locations on the periphery. No portion of the weldment is located on the face 58. With a completed clubhead, upon impact of the face 58 with a ball, the weldment experiences substantially only compression forces, to which the weldment is highly resistant. In contrast, welds made in the face of a conventional clubhead are nearly parallel to the impact force and thus experience significant tensile and shear forces. In other words, for a given thickness, the face of the subject iron-type clubhead is substantially stronger than the face of a conventional welded iron-type clubhead. Consequently, the face 58 can be made thinner (e.g., 1.6-2.0 mm), as described above, than the face of a conventional iron-type clubhead without sacrificing required strength and durability. Also, since the laser weldment generally has a narrower FZ 82 compared to a TIG weldment, for example, the clubhead can be configured with a narrower top-line (e.g., 4-7 mm) than a conventional iron-type clubhead. Even with the narrowest top-line, the weld zone 80 does not encroach upon the face 58, so the top-line can be as narrow as practicable while still satisfying this criterion. A thin top-line provides a "classic" blade look to the iron, which many golfers prefer from the standpoint of visual aesthetics and/or "feel."

Another advantage to being able to form a high-strength but thinner face 58 exhibiting higher COR than conventionally is the option of not having to form undercuts around the interface surfaces 72, 74, particularly along the top line. This is another factor allowing the top-line to be narrower than conventionally.

After completion of welding, the clubheads are subjected to a heat treatment for, inter alia, aging. This post-weld heat treatment is generally at 480-540° C. for four hours. The clubheads are also finish-machined as required (generally grinding and polishing) to smooth and topologically blend the surface of the weldment into the contour of the clubhead. Polishing produces an excellent surface finish on which the weldment is invisible. Finish machining desirably is followed by passivation.

Before or after surface finish machining, a region (usually within the length range of 0.25 to 1.0 inch) of the hosel 56 can be subjected to a local induction treatment (e.g., 800° C. for 3-10 seconds) to facilitate adjustment of the hosel-lie angle. Induction is immediately followed by rapid cool in air. Experience has shown that the lie-angle of the hosel has greater than 9 degrees of adjustability using this method.

After completing finish-machining, it may be desirable to execute a suitable surface treatment of the clubhead, such as plating, painting, coating, or the like. Plating may be performed to produce a surficial "plating" layer that protects against corrosion and is strong, durable, relatively inert, and aesthetically pleasing. Exemplary materials for forming a surficial plating layer are Cr, Ni, and Cu. Exemplary techniques for forming the surficial plating layer are electrode plating, electroless plating, physical vapor deposition (PVD), chemical vapor deposition (CVD), ion plating (IP), and ion-beam-enhanced diffusion (IBED).

It is desirable that a plating sublayer (intermediate layer) be applied to the clubhead before applying the surficial plating layer in order to enhance adhesion of the surficial plating layer to the clubhead. This is because most plating layers are brittle and may crack under stress. Exemplary materials for use in forming the plating sublayer are soft nickel, soft copper, and oxides. The plating sublayer is applied in a conventional manner such as any of the methods listed above for forming the surficial plating layer.

Other techniques for applying a protective layer to the clubhead are painting, powder coating, ferritic nitro carburizing, passivation, and other processes that are familiar to persons of ordinary skill in the relevant art.

Figure 3:
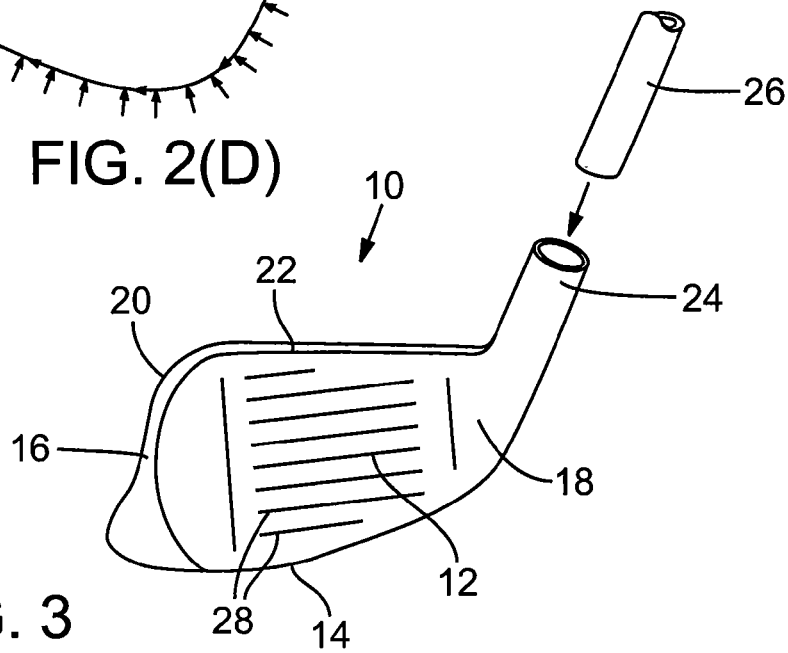
FIG. 3 (PRIOR ART)
FIG. 3 is a perspective view of relevant features of a conventional iron-type clubhead, including a portion of the shaft. This figure is similar to FIG. 3 in the parent case.

A clubhead as generally described above is made into a golf club by attaching a suitable shaft to the hosel (see FIG. 3). Various conventional methods for attaching a shaft to a hosel are known in the art. Also, various types of shafts are known and available, including non-metallic shafts. For comfortable use of the club, a grip is attached to the shaft.

Figure 6:
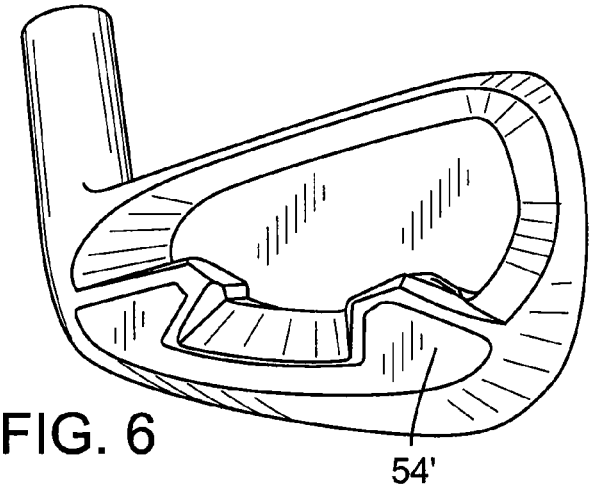
FIG. 6 is a rear view of an embodiment in which the rear piece 54' is called a "toe-heel weight" back.

The rear piece 54 shown in the embodiment of FIGS. 1(B) and 1(C) is exemplary only, and is called a "central weight" back in which more mass is present in the vicinity of the midline of the back. Another embodiment is shown in FIG. 6 in which the rear piece 54' is called a "toe-heel weight" back, in which more mass is present in the vicinity of the heel and toe of the back than in the vicinity of the midline.

Therefore, iron-type clubheads are provided having at least the following advantages: (a) made of two pieces, a front piece and a rear piece, the front piece including the hosel and face; (b) face can be small (2950-3000 $mm^2$); (c) the front piece desirably is forged of a high-strength steel alloy, which allows the face to be made thin (e.g., 1.6-2.0 mm); (d) the face can be formed with a patterned thickness distribution (e.g., a variable thickness sweet spot); (e) the pieces are welded together along a contact interface that avoids forming any of the weld on the face, producing a strong and durable face despite its thinness; (f) welding desirably is by laser welding, which allows the top-line to be thin (less than 7 mm); (g) making the face thinner frees up discretionary mass for placement elsewhere on the clubhead, such as in the toe, heel, or lower back region, to lower the CG of the clubhead further than conventionally; (h) the face can have a higher COR (e.g., 0.78 to 0.83) than in conventional iron-type clubheads; and (i) the high strength of the front piece also provides the club with high MOI.

Example 1

In this example, five clubheads were made in which the front piece was forged of C455 stainless steel, and the rear piece was cast of 17-4 stainless steel. Heat-treatment of the front piece before welding was 830° C. for 90 min (solution quench), and of the rear piece before welding was 1040° C. for 90 min (solution quench). Post-weld heat treatment (aging) was 538° C. ("H1000", or 1000° F.) for four hours. The hosel of one clubhead was induction-treated to adjust the lie angle. The following data were obtained:

TABLE 1

| Club-head | Face Thickness | Face Flatness | Face Hardness | COR | Wt | Face Def. 3000 shot | Hosel Bend |
|---|---|---|---|---|---|---|---|
| 1 | 1.86 mm | <0.1 | 44.5 HRC | 0.803 | 242.8 g | | |
| 2 | 1.87 mm | <0.1 | 45.0 HRC | 0.801 | 243.0 g | | |
| 3 | 1.93 mm | <0.1 | 45.0 HRC | | | | −4.5° |
| 4 | 1.86 mm | <0.1 | | | | 0.08 | |
| 5 | 1.83 mm | <0.1 | | | | 0.06 | |

The "Face Def." is persistent face deflection after 3000 "shots" of a golf ball were directed at the face. Ball velocity was 46 m/s. Face-deflection data are in mm. Note that the specification was a deflection≤0.2 mm, so the clubheads exhibited excellent durability in this regard. "HRC" is Rockwell hardness "C" scale.

Example 2

An iron-type clubhead was made, from which the following data on head mass were obtained:

TABLE 2

| | |
|---|---|
| Delta 1: | −8.56 mm |
| Delta 2: | 34.88 mm |
| Delta 3: | 65.94 mm |
| z-up: | 18.4 mm |

The "delta" values are coordinate-conversion numbers. The "z-up" dimension is the vertical coordinate of the CG. Hence, in the clubhead of this example, the CG is lower than conventionally.

Example 3

In this example, data regarding mechanical properties were obtained from three sample clubheads.

TABLE 3

| Sample # | Material | Yield (MPa) | Tensile (MPa) | Elongation | Modulus |
|---|---|---|---|---|---|
| 1 | 455 | 1325.5 | 1365.5 | 11.9% | 182.8 GPa |
| 2 | 455 | 1353.6 | 1382.8 | 10% | 195.9 GPa |
| 3 | 455 | 1369 | 1406.2 | 10.5% | 198.6 GPa |

Example 4

In this example, the following analytical data were obtained of the elemental composition of the 455 stainless steel used for forging front pieces of the clubheads:

TABLE 4

| Element | Concentration | Specification |
|---|---|---|
| C | 0.05 | <0.05 |
| Mn | 0.36 | <0.5 |
| P | 0.018 | <0.04 |
| S | 0.002 | <0.03 |
| Si | 0.41 | <0.5 |
| Cu | 2.1 | 1.5-2.5 |
| Cr | 11.99 | 11.00-12.50 |
| Ni | 7.78 | 7.5-9.5 |
| Mo | 0.59 | <0.5 |
| Ti | 0.92 | 0.8-1.4 |
| Al | 0.11 | |
| Fe | Balance | Balance |

Whereas the invention has been described in connection with representative embodiments, it will be understood that it is not limited to those embodiments. On the contrary, it is intended to encompass all alternatives, modifications, and equivalents as may be included within the spirit and scope of the invention as defined by the appended claims.

What is claimed is:

1. A clubhead for a golf club, comprising:

a front piece including an iron-type face, a front heel portion, a front sole portion, a front toe portion, a front top-line portion, a hosel, and a respective interface surface facing substantially rearwardly of the face;

a rear piece including a rear heel portion, a rear sole portion, a rear toe portion, a rear top-line portion, and a respective interface surface facing the interface surface of the front piece and, with the interface surface of the front piece, forming a contact interface of the front and rear pieces, the contact interface having a periphery, an open middle region defined by an inside edge, and a width between the inside edge and the periphery, the width being variable with position around the periphery so as to be widest in regions of the heel portions and narrowest in regions of the top-line portions, and intermediately wide in other regions of the contact interface, the rear piece including a weighting element; and a continuous laser weld extending circumferentially around the periphery of the contact interface and attaching the front and rear pieces together at the contact interface, the weld including a fusion zone that, at substantially all locations around the contact interface, extends depthwise from the periphery into the contact interface in a direction substantially perpendicular to a normal to the face, the fusion zone having a depth that varies according to corresponding variations in the width of the contact interface around the periphery;

wherein a combined thickness of the front and rear top-line portions is no greater than 7 mm, wherein a damping badge is connected to a rear surface of the front piece, and wherein the front piece includes at least one projection aligning with an inside edge of the interface surface of the rear piece.

2. The clubhead of claim 1, wherein the face has a COR of at least 0.8.

3. The clubhead of claim 1, wherein the face has an area of less than 3000 $mm^2$.

4. The clubhead of claim 1, wherein the front piece is forged of a steel selected from the group consisting of maraging steels, maraging stainless steels, and PH stainless steels.

5. The clubhead of claim 4, wherein the stainless steel is C455 or 17-4 stainless steel.

6. The clubhead of claim 1, wherein the face has a maximum thickness of 2.0 mm.

7. The clubhead of claim 1, wherein the top-line has a thickness of 4-6 mm.

8. A clubhead for a golf club, comprising:

a front portion including an iron-type face, a hosel, a heel, a sole, a toe, a top-line situated rearwardly of the face, and a respective interface surface facing substantially rearwardly of the face; and a rear portion situated rearwardly of the heel, sole, toe, and top-line of the front portion, the rear portion having a respective interface surface facing the interface surface of the front portion and substantially conforming to the interface surface of the front portion in a contact interface, the contact interface having a periphery and width that varies with position around the periphery;

a continuous laser weld bonding the front and rear portions together around the periphery of the contact interface, the laser weld having depth in the contact interface that varies according to corresponding variations of depth of the contact interface;

wherein the face has a COR of at least 0.8 and a thickness, in a thinnest portion of the face, of no greater than 2.0 mm, and the top-line has a thickness of no greater than 7 mm, wherein a damping badge is connected to a rear surface of the front portion, and wherein the front portion includes at least one projection aligning with an inside edge of the interface surface of the rear portion.

9. The clubhead of claim 8, wherein the front is a forgement.

10. The clubhead of claim 9, wherein the forgement is of a material selected from group consisting of maraging steels, maraging stainless steels, and PH stainless steels.

11. The clubhead of claim 8, wherein the face has an area of less than 3000 $mm^2$.

12. The clubhead of claim 8, wherein the top-line has a thickness of 4-6 mm.

* * * * *